United States Patent [19]

Kruschel

[11] 4,111,022

[45] Sep. 5, 1978

[54] MANUAL CRIMPING TOOL

[75] Inventor: William A. Kruschel, Oakdale, Minn.

[73] Assignee: Minnesota Mining and Manufacturing Company, St. Paul, Minn.

[21] Appl. No.: 793,084

[22] Filed: May 2, 1977

[51] Int. Cl.[2] ..... B21D 7/06

[52] U.S. Cl. ..... 72/410; 81/9.1 R

[58] Field of Search ..... 72/409, 410, 399, 394; 29/243.56, 751; 140/93.4; 81/9.1 R

[56] References Cited

U.S. PATENT DOCUMENTS

| | | | |
|---|---|---|---|
| 1,031,738 | 7/1912 | Sheldon | 72/399 |
| 2,315,596 | 4/1943 | Childress | 81/9.1 R |
| 2,680,979 | 6/1954 | Childress | 81/9.1 R |
| 3,166,960 | 1/1965 | Roessler | 81/9.1 R |

FOREIGN PATENT DOCUMENTS

| | | | |
|---|---|---|---|
| 671,083 | 1/1939 | Fed. Rep. of Germany | 81/9.1 R |

*Primary Examiner*—C.W. Lanham
*Assistant Examiner*—Gene P. Crosby
*Attorney, Agent, or Firm*—Cruzan Alexander; Donald M. Sell; William L. Huebsch

[57] ABSTRACT

A manually operated tool adapted to crimp a sheet metal clasp around overlapped lengths of non-metallic strap. The tool is operated by manually pressing together a pair of handles. A first portion of such handle movement pivots opposed die members from an open position at which opposed ledges on projecting ends of the die members are spaced apart to afford positioning the die members on opposite sides of the clasp, to a closed position at which the projecting ledges are closely adjacent to essentially encircle the clasp within a passageway defined by the die members and a plunger between the die members. A second portion of such handle movement maintains the die members in their closed position and drives the plunger toward the ledges to crimp the clasp against a die surface defined on the ledges.

4 Claims, 8 Drawing Figures

MANUAL CRIMPING TOOL

BACKGROUND OF THE INVENTION

This invention relates to tools for crimping sheet metal clasps around overlapped lengths of strap, and in one aspect to such a tool which is manually operated.

Many prior art tools are known for crimping sheet metal clasps around overlapped lengths of strap to attach the lengths of strap together. Included are tools for crimping a known prior art type of sheet metal clasp particularly adapted for use on non-metallic strap such as the No. 315 clasp available from Minnesota Mining and Manufacturing Co., St. Paul, Minn. This type of clasp includes a generally planar base portion having a serrated contact surface with a width between first and second parallel edges generally corresponding to the width of the strap to be joined; and a generally curved top portion with a serrated inner surface joining the base portion along the first parallel edge of the contact surface, projecting over the base portion in a spaced relationship to afford positioning overlapped lengths of strap therebetween, and being adapted to overlap the base portion when pressed over the overlapped lengths of strap thereon with the distal edge of the top portion along the second edge of the base portion. The clasp also includes a locking lip projecting generally normal to the base portion toward the top portion along the second edge of the contact surface, and having a height affording engagement thereof over the distal edge of the top portion to lock the top portion in place after the top portion is pressed over overlapped lengths of strap between the top and base portions.

One known type of tool for crimping the clasp described above is sold by A. Konrad, Feinmechanik A.G., Merenschwand, Switzerland and designated KO76. This tool is a combination crimping and tensioning tool which includes a base adapted to locate a clasp through which overlapped lengths of strap are positioned, and means for manually driving a die block into engagement with the top portion and locking lip of a located clasp to crimp the clasp. While this tool will securely crimp the clasp on non-metallic strap, it is quite complex and thus more expensive than may be desired for many applications. Additionally, with this tool only one edge of the die block can roll the locking lip over the top portion of the clasp, so that the workman must always orient the clasp on the tool with its locking lip along a predetermined edge of the die block.

SUMMARY OF THE INVENTION

The present invention is a manually operated tool adapted to crimp clasps of the aforementioned type on non-metallic or plastic strap (such as of polyester, polypropylene, polyamide or a polyolefin co-polymer) which is relatively inexpensive, and will seal the clasp with its locking lip in either of two orientations relative to the tool.

According to the present invention there is provided a tool for crimping such clasps including means for defining a die surface comprising a planar central portion adapted to engage and bend the top portion of a clasp toward its base portion, and arcuate outer surface portions recessed on both sides of the central portion, either of which is adapted to roll the locking lip of the clasp over its top portion. The tool includes manually operated means for pressing the top portion and locking lip of a clasp into engagement with the die surface, and separable wall means to afford positioning the die surface and means for pressing around the clasp and to afford removal of the tool from around the crimped clasp, which separable walls means are adapted to essentially encircle the clasp and retain it in a predetermined position during crimping of the clasp.

In its preferred embodiment the tool comprises a frame; and a pair of die members (included in the separable wall means) each including a body portion pivotably mounted on the frame with one end projecting therefrom, and a ledge projecting from one side of the projecting end to provide a generally L-shaped die member. The die members are mounted with the ledges in opposed relationship and to afford movement between an open position with the ledges spaced apart so that the projecting ends of the die members may be positioned on opposite sides of an uncrimped clasp through which overlapping lengths of strap are positioned, and a closed position with the ledges closely adjacent. Also included are a pair of handles, means mounting the handles for pivotable movement relative to each other between first, second and third positions, and means for pivotably coupling the handles to the die members to move the die members from their open position to their closed position upon movement of the handles from their first position to their second position and for maintaining the die members in their closed position upon movement of the handles between their second and third positions. Means are also provided coupling a plunger to the handles to move the plunger between the opposed die members through positions spaced more than a predetermined distance from the ledges of the die members to afford positioning an open clasp therebetween when the levers are between their first and second positions, and to move the plunger to an engaged position to crimp the clasp against the ledges (on which ledges the die surface is defined) as the handles are moved through their second position toward their third position.

BRIEF DESCRIPTION OF THE DRAWING

The invention will be further described with reference to the accompanying drawing wherein like numbers refer to like parts in the several views, and wherein.

DESCRIPTION OF THE PREFERRED EMBODIMENT

Figure 1:
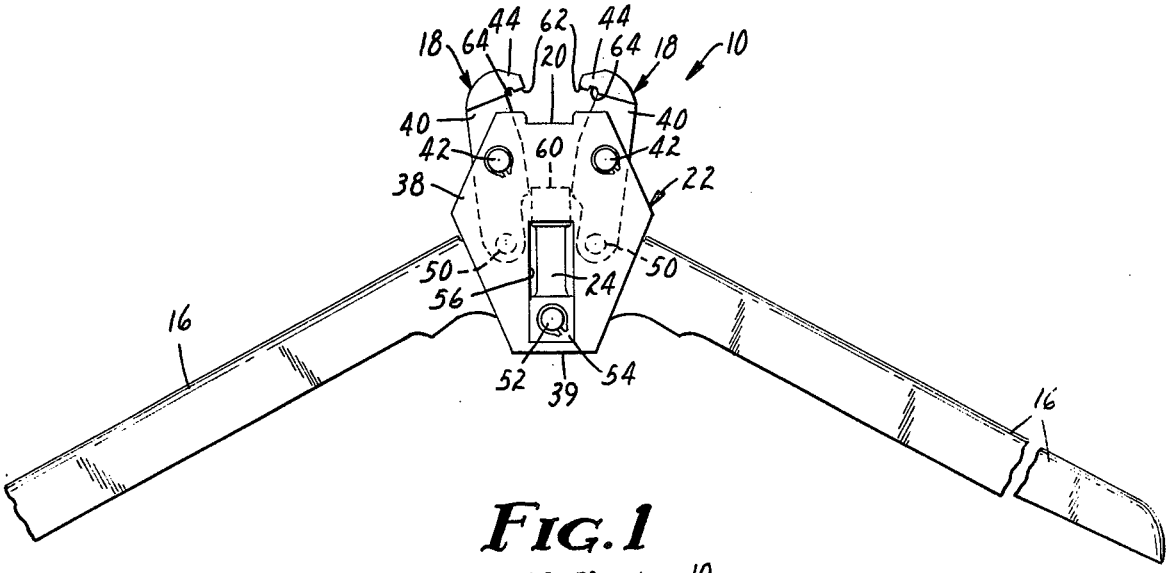
FIG. 1 is a fragmentary side view of a clasp crimping tool according to the present invention.
Figure 2:
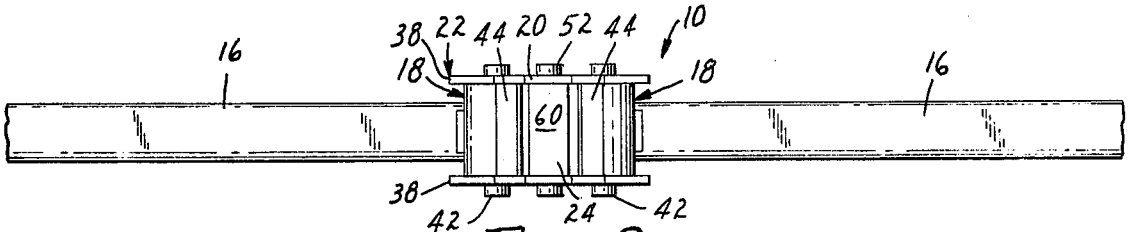
FIG. 2 is a fragmentary top view of the tool of FIG. 1.
Figure 3:
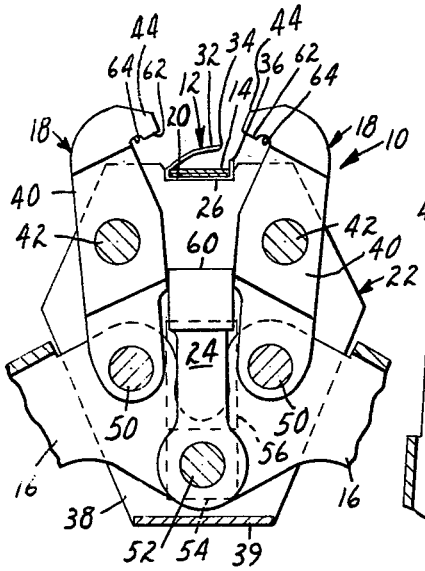
FIGS. 3, 4, 5 and 6 are fragmentary views which sequentially illustrate the crimping of a clasp by the tool of FIG. 1, with FIGS 3, 5 and 6 having parts broken away to show details.
Figure 5:
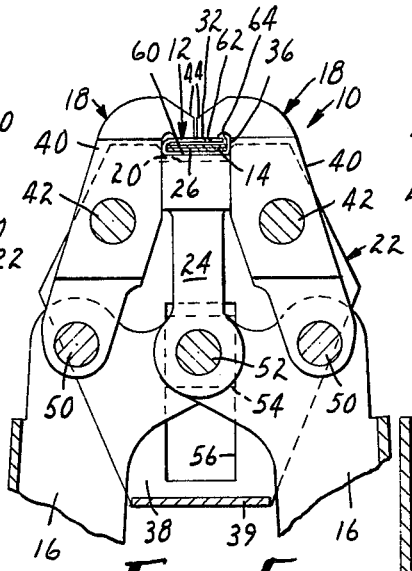
Figure 6:
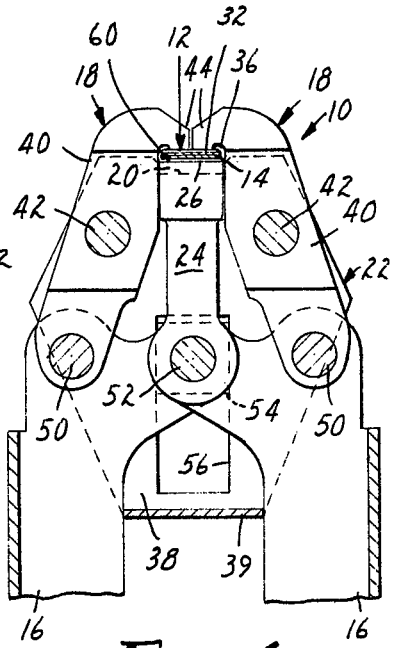
Figure 7:
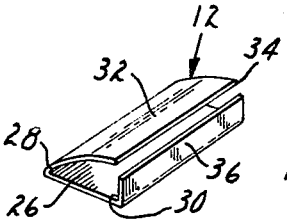
FIGS. 7 and 8 illustrate a known prior art clasp of the type which the tool of FIG. 1 is designed to crimp, shown uncrimped in FIG. 7 and crimped about overlapped lengths of strap in FIG. 8.
Figure 8:
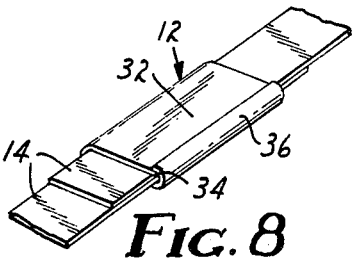

Referring now to FIGS. 1 through 6 of the drawing there is illustrated a crimping tool according to the present invention generally designated by the numeral 10. The tool 10 is adapted for crimping the sheet metal clasp 12 illustrated in FIG. 7 to attach together the overlapped lengths of plastic strap 14 as is shown in FIG. 8 by manually pressing together the ends of two handles 16. Such movement of the handles 16 first pivots closed the projecting ends of two die members 18 to encircle the clasp 12 within a passageway defined between the die members 18 and edges 20 of a frame 22 for the tool 10 (FIG. 4), and then moves a plunger 24 to press the clasp 12 against a die surface defined on the die members 18 which is shaped to close the clasp 12 (FIG. 6).

The clasp 12 (FIG. 7) is of a known type (e.g. No. 315 available from Minnesota Mining and Manufacturing Co., St. Paul, Minn.) including a generally planar base portion 26 having a serrated inner surface with a width between first and second parallel edges 28 and 30 corresponding generally to the width of the lengths of strap 14 to be joined. The clasp 12 also includes a generally curved top portion 32 with a serrated inner surface joining the base portion 26 along the first parallel edge 28, projecting over the base portion 26 in a spaced relationship to afford positioning overlapped lengths of strap 14 therebetween, and being adapted to overlap the base portion 26 when pressed over the lengths of strap 14 thereon (FIG. 8) with a distal edge 34 of the top portion 32 along the second parallel edge 30. Also included in the clasp 12 is a locking lip 36 projecting generally normal to the base portion 26 toward the top portion 32 along the second edge 30 and having a height affording engagement thereof over the distal edge 34 of the top portion 32 (FIG. 8) after the top portion 32 is pressed over lengths of strap 14 between the top and base portions 26 and 32.

The tool 10 for crimping the clasp 14, seen in FIGS. 1 through 6, includes the frame 22 which is generally U-shaped and includes planar parallel side walls 38 joined by a bottom wall 39. The pair of die members 18 each includes a generally rectangular body portion 40 pivotably mounted between the side walls 38 of the frame 22 at a pin 42 so that an end of the die member 18 projects from the frame 22, and comprises a ledge 44 on one side of its projecting end. The pins 42 provide means mounting the die members 18 on the frame 22 with the ledges 44 in opposed relationship and so that the die members 18 are pivotable between an open position with the ledges 44 spaced apart to afford positioning the projecting ends of the die members 18 on opposite sides of an uncrimped clasp 12 through which extend overlapping lengths of strap 14 (FIGS. 1, 2 and 3), and a closed position with the ledges 44 of the die members 18 closely adjacent (FIGS. 4, 5 and 6) so that the projecting ends of the die members 18 and the adjacent edges 20 of the frame 22 (the side walls 38 of which are notched and spaced to receive the ends of the clasp 12 in a position bridged between the side walls 38) essentially encircle the uncrimped clasp 12.

Figure 4:
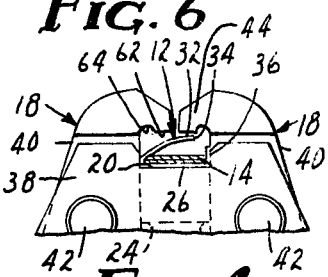

Ends of the handles 16 are pivotably mounted to the ends of the die members 18 opposite the ledges 44 via pins 50, and are pivotably mounted together via a pin 52. Slide members 54 are attached to the opposite ends of the pin 52 and are slidably engaged in opposed parallel slots 56 in the side walls 39 of the frame 22, which slots 56 are disposed at right angles to and bisect a straight line between the axes of the pins 42. The pins 50 and 52 are disposed so that a line joining the axes of the pins 50 and 52 on each handle 16 is disposed at generally a right angle with the centerline of the handle 16. Spreading the handles 16 moves the slide members 54 along the slots 56 (the orientation of which insures equal spreading movement of the die members 18) away from the die members 18, and moves the pins 50 toward each other to spread the projecting ends of the die members 18. Such spreading movement is stopped by engagement of the body portions 40 with the opposite sides of the plunger 24 at a first position of the handles 16 (FIGS. 1, 2 and 3) with the handles 16 spread at an included angle of about 110 degrees, with the die members 18 in their open position, and with the slide members 54 adjacent the ends of the slots 56. Subsequent movement of the handles 16 toward each other will move the slide members 54 toward the opposite ends of the slots 56 and pivot the die members 18 toward their closed position which will be essentially reached shortly before the pin 50 moves into alignment with the pins 52 when the handles 16 are in a second position spread at an included angle of about 35° (FIG. 4). Subsequent movement of the handles toward each other moves the pins 50 and 52 into alignment, and moves the handles 16 to a third, essentially parallel position (FIG. 6) defined by engagement of the slide members 54 against the ends of the slots 56. Such movement of the handles 16 between their second and third positions will cause very little movement of the projecting ends of the die members 18 so that the die members 18 are essentially retained in their closed position.

The tool also provides means for driving the plunger 24 toward the ledges 44 on the die members 18 to crimp the clasp 12 therebetween as the handles 16 are moved from their second to their third positions.

The plunger 24 is pivotably attached to the pin 52 and projects toward the ledges 44 into an opening defined between the adjacent surfaces of the die members 18 and side walls 38 of the frame 22. The pin 52 provides means for coupling the plunger 24 to the handles 16 to move the plunger 24 between the opposed die members 30 through positions (FIGS. 3 and 4) with a planar end surface 60 on the plunger 24 spaced sufficient distances (or more than a predetermined distance defined by the edges 20) from the ledges 44 of the die members 18 to afford positioning an open clasp 12 therebetween against the edges 20 of the frame 22 when the handles 16 are between their first and second positions. As the handles 16 are moved from their second position toward their third position, however, the end surface 60 on the plunger 24 will engage a clasp 12 bridging across the edges 20 and press it against the adjacent surfaces of the ledges 44 of the die members 18 (which are then in their closed position), until the plunger 24 reaches an engaged position spaced less than the predetermined distance defined by the edges 20 and sufficiently close from the ledges 44 that a clasp 12 therebetween must be crimped. The surfaces of the ledges 44 opposite the end surface 60 of the plunger 24 provide a die surface comprising a central planar portion 62 adapted to engage and bend the top portion 32 of the clasp 12 over overlapped lengths of strap 14 through the clasp 12 (FIG. 5), and arcuate or cylindrically concave recessed outer surface portions 64 either of which is adapted to roll the locking lip 36 of the clasp 12 over its top portion 32 as the plunger 24 presses the clasp 12 toward the ledges 44 during movement of the plunger 24 to its engaged position (FIG. 6) so that the clasp may be positioned in either of two orientations between the plunger 24 and the die surface.

Operation

To apply a clasp 12 an operator first positions the top portion 32 of the clasp 12 between overlapping lengths of strap 14 and the item to be contained thereby, with the overlapped lengths of strap 14 between the top and base portions 32 and 26 of the clasp 12, after as much tension as is deemed appropriate has been applied in the strap 14 by a separate tensioning tool. He then spreads the handles 16 of the crimping tool 10 to position the die members 18 in their open position with the ledges 44 spaced apart, and positions the projecting ends of the die members 18 on the sides of the clasp 12 with the base portion 26 of the clasp cradled in the frame 22 between the die members 18 in the notches along the edges 20. Next the operator moves the handles 16 from their first to their second position (FIG. 4) which moves the pin 52 toward a position between the pins 50 to position the die members 18 in their closed position with the ledges 44 of the die members 18 close together so that the die members 18 and edges 20 of the frame 22 encircle the clasp 14. Further movement of the handles 16 to their third position moves the end surface 60 of the plunger 24 against the base portion 26 of the clasp 12 and presses it against the die surface on the ledges 44, which presses the top portion 32 of the clasp 12 over the straps 14 by contact with the central portion 62 of the die surface (FIG. 5) and then rolls the locking lip 36 of the clasp 12 over its distal edge 24 by contact against one of the arcuate outer portions 64 of the die surface. The clasp 12 is then attached, and the operator removes the tool 10 by again spreading the handles 16.

I claim:

1. A manually operated tool adapted to crimp a clasp around overlapped lengths of non-metallic strap, said tool comprising a frame; a pair of die members each including a body portion and a projecting ledge at one end of said body portion, said ledge and body portion being disposed to provide a generally L-shaped die member; means mounting said die members on said frame with said ledges in opposed relationship for pivotal movement between an open position with said ledges spaced apart to afford positioning said body portions on opposite sides of an uncrimped clasp around overlapping lengths of strap, and a closed position with the ledges closely adjacent; a pair of handles; means mounting said handles for pivotable movement relative to each other between first, second and third positions; means for pivotably coupling said handles to said die members to move said die members from their open position to their closed position upon movement of said handles from their first position to their second position and for maintaining said die members in their closed position upon movement of said handles between their second and third positions; a plunger; and means coupling said plunger to said handles to move said plunger between said opposed die members through positions spaced more than a predetermined distance from the ledges of said die members to afford positioning an open clasp therebetween when said levers are moved between their first and second positions and to move said plunger to an engaged position spaced less than said predetermined distance from said ledges as said handles are moved from their second position toward their third position, the surfaces of said ledges opposite said plunger providing die surfaces comprising planar central portions adapted to engage and bend a top portion of a said clasp over overlapped lengths of straps extending through the clasp and having recessed arcuate outer cam surfaces adapted to roll a locking lip of the clasp over its top portion as said plunger presses the clasp toward said ledges during movement of said plunger to its engaged position.

2. A manually operated tool adapted to crimp a clasp around overlapped lengths of non-metallic strap, said tool comprising a frame; a pair of members each including a body portion and a projecting ledge at one end of said body portion, said ledge and body portion being disposed to provide a generally L-shaped member; means mounting said members on said frame with said ledges in opposed relationship for pivotal movement between an open position with said ledges spaced apart to afford positioning said body portions on opposite sides of an uncrimped clasp around overlapping lengths of strap, and a closed position with the ledges closely adjacent; a pair of handles; means mounting said handles for pivotable movement relative to each other between first, second and third positions; means for pivotably coupling said handles to said members to move said members from their open position to their closed position upon movement of said handles from their first position to their second position and for maintaining said members in their closed position upon movement of said handles between their second and third positions; a plunger; and means coupling said plunger to said handles to move said plunger between said opposed members through positions spaced more than a predetermined distance from the ledges of said members to afford positioning an open clasp therebetween when said levers are moved between their first and second positions and to move said plunger to an engaged position spaced less than said predetermined distance from said ledges as said handles are moved from their second position toward their third position, one of the opposed surfaces defined by said ledges and by said plunger providing a die surface comprising a planar central portion adapted to engage and bend a top portion of a said clasp over overlapped lengths of straps extending through the clasp and having a recessed arcuate outer cam surface portion adapted to roll a locking lip of the clasp over its top portion as said plunger presses the clasp toward said ledges during movement of said plunger to its engaged position.

3. A manually operated tool according to claim 2, wherein said die surface has two arcuate outer cam surface portions adapted to roll the locking lip of a said clasp over its top portion, said cam surfaces being on opposite sides of said central portion to afford orientation of said die surface in either of two orientations relative to a said clasp.

4. A manually operated tool adapted to crimp a clasp around overlapped lengths of non-metallic strap, said tool comprising a frame; wall means mounted on said frame for defining a channel adapted to receive a said clasp, said wall means having portions movable between an open spaced apart position affording positioning said wall means about a said clasp which is uncrimped and positioned around overlapping lengths of strap, and a closed position with said wall means essentially encircling a said clasp; a pair of handles; means mounting said handles for pivotable movement relative to each other between first, second and third positions; means for pivotably coupling said handles to said wall means to move said wall means from their open position to their closed position upon movement of said handles from their first position to their second position and for maintaining said wall means in their closed position upon movement of said handles between their second and third positions; a plunger; and means coupling said plunger to said handles to maintain said plunger at positions spaced more than a predetermined distance from said wall means to afford positioning an open clasp therebetween when said levers are moved between their first and second positions and to move said plunger to an engaged position spaced less than said predetermined distance from said wall means as said handles are moved from their second position toward their third position, one of the opposed surfaces of said wall means and said plunger providing a die surface comprising a planar central portion adapted to engage and bend a top portion of the clasp over overlapped lengths of straps extending through the clasp and having recessed arcuate cam surface portions on opposite sides of said central portion, either of which arcuate cam surfaces in adapted to roll a locking lip of the clasp over its top portion as said plunger presses the clasp toward said wall means so that the die surface may be oriented in either of two positions relative to a said clasp.

* * * * *